US010420988B2

(12) United States Patent
Nakamura

(10) Patent No.: US 10,420,988 B2
(45) Date of Patent: Sep. 24, 2019

(54) GOLF CLUB

(71) Applicant: DUNLOP SPORTS CO. LTD., Kobe-shi, Hyogo (JP)

(72) Inventor: Takashi Nakamura, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 459 days.

(21) Appl. No.: 14/736,688

(22) Filed: Jun. 11, 2015

(65) Prior Publication Data

US 2015/0360092 A1 Dec. 17, 2015

(30) Foreign Application Priority Data

Jun. 12, 2014 (JP) ..... 2014-121665

(51) Int. Cl.

| | |
|---|---|
| ***A63B 53/04*** | (2015.01) |
| ***A63B 53/10*** | (2015.01) |
| ***A63B 53/14*** | (2015.01) |
| ***A63B 53/00*** | (2015.01) |
| *A63B 60/00* | (2015.01) |
| *A63B 60/42* | (2015.01) |

(52) U.S. Cl.

CPC ..... *A63B 53/0466* (2013.01); *A63B 53/00* (2013.01); *A63B 53/10* (2013.01); *A63B 53/14* (2013.01); *A63B 60/42* (2015.10); *A63B 2060/002* (2015.10); *A63B 2209/023* (2013.01)

(58) Field of Classification Search

CPC ..... A63B 53/0466; A63B 2053/0408; A63B 53/00; A63B 2053/0412; A63B 60/24; A63B 2209/00; A63B 53/04

USPC ..... 473/292, 324, 334, 349

See application file for complete search history.

(56) References Cited

U.S. PATENT DOCUMENTS

| | | | | |
|---|---|---|---|---|
| 6,478,689 | B1 * | 11/2002 | Hisamatsu | A63B 24/0021 473/287 |
| 7,326,125 | B2 * | 2/2008 | Moriyama | A63B 53/00 473/292 |
| 7,416,495 | B2 * | 8/2008 | Ban | A63B 53/00 473/292 |
| 7,850,542 | B2 * | 12/2010 | Cackett | A63B 53/0466 473/316 |
| 8,678,945 | B2 * | 3/2014 | Rice | A63B 53/10 473/292 |

(Continued)

FOREIGN PATENT DOCUMENTS

| | | |
|---|---|---|
| JP | 2004-201911 A | 7/2004 |
| JP | 3735208 B2 | 1/2006 |

*Primary Examiner* — William M Pierce

(74) *Attorney, Agent, or Firm* — Birch, Stewart, Kolasch & Birch, LLP

(57) ABSTRACT

A club 2 includes a head 4, a shaft 6, and a grip 8. A club length L1 is 43 inches or greater and 48 inches or less. A ratio (Wh/Wc) of a head weight Wh to a club weight Wc is equal to or greater than 0.66. An inertia moment Ix about a swing axis is $7.20\times10^3$ (kg·cm$^2$) or greater and $7.50\times10^3$ (kg·cm$^2$) or less. A static moment Mt (kg·cm) of the club is equal to or greater than 16.0 (kg·cm). The inertia moment Ix (kg·cm$^2$) is calculated by the following formula (1). Lc is an axial-directional distance between a grip end and a center of gravity of the club.

$$Ix=Wc\times(Lc+60)^2+Ic \quad (1)$$

8 Claims, 4 Drawing Sheets

(56) References Cited

U.S. PATENT DOCUMENTS

| | | | | |
|---|---|---|---|---|
| 8,882,607 | B2 * | 11/2014 | Nakamura | A63B 53/00 473/292 |
| 2006/0009302 | A1 * | 1/2006 | Oyama | A63B 53/0466 473/282 |
| 2013/0095944 | A1 | 4/2013 | Nakamura et al. | |
| 2015/0126297 | A1 * | 5/2015 | Brekke | G01B 5/0023 473/292 |

* cited by examiner

GOLF CLUB

The present application claims priority on Patent Application No. 2014-121665 filed in JAPAN on Jun. 12, 2014, the entire contents of which are hereby incorporated by reference.

BACKGROUND OF THE INVENTION

Field of the Invention

The present invention relates to a golf club.

Description of the Related Art

Examples of important evaluation items for a golf club include a flight distance.

A golf club intending the increase of the flight distance has been proposed. Japanese Patent Application Laid-Open No. 2004-201911 discloses a wood club in which the rate of mass of a head to the total mass of a golf club is 73% or greater and 81% or less. A golf club considering the stability of swing has been proposed. Japanese Patent No. 3735208 discloses a golf club in which a moment of inertia ($g \cdot m^2$) about a grip end is 200 or greater and 300 or less and the period (sec) of flexural vibration is 0.2650 or greater and 0.340 or less. Japanese Patent Application Laid-Open No. 2013-81688 (US2013/0095944) discloses a golf club in which (Wh/Wc)×(Lg/Ls) is equal to or greater than 0.365.

SUMMARY OF THE INVENTION

Demand for a flight distance performance is more and more increased. A golf club which is easily to be swung and has an excellent flight distance performance is demanded. Furthermore, a club having decreased variation in a hit ball and high stability is particularly demanded for a golfer having good physical strength. The inventor has found out that the easiness of swing can be appropriately evaluated and the stability can be secured using a new index.

It is an object of the present invention to provide a golf club having excellent easiness of swing and stability.

A preferable golf club according to the present invention includes a head, a shaft, and a grip. Preferably, a club length is 43 inches or greater and 48 inches or less. Preferably, a ratio (Wh/Wc) of a head weight Wh to a club weight Wc is equal to or greater than 0.66. Preferably, an inertia moment Ix about a swing axis is $7.20\times10^3$ ($kg \cdot cm^2$) or greater and $7.50\times10^3$ ($kg \cdot cm^2$) or less. Preferably, a static moment Mt ($kg \cdot cm$) of the club is equal to or greater than 16.0 ($kg \cdot cm$).

If the club weight is defined as Wc (kg); an axial-directional distance between a grip end and a center of gravity of the club is defined as Lc (cm); and a club inertia moment about the center of gravity of the club is defined as Ic ($kg \cdot cm^2$), the inertia moment Ix ($kg \cdot cm^2$) is calculated by the following formula (1), and the static moment Mt ($kg \cdot cm$) is calculated by the following formula (2).

$$Ix = Wc \times (Lc+60)^2 + Ic \quad (1)$$

$$Mt = Wc \times (Lc-35.6) \quad (2)$$

Preferably, a frequency of vibration of the club is 240 (cpm) or greater and 290 (cpm) or less.

Preferably, the ratio (Wh/Wc) is equal to or greater than 0.67.

DESCRIPTION OF THE PREFERRED EMBODIMENTS

Hereinafter, the present invention will be described in detail according to the preferred embodiments with appropriate references to the accompanying drawings.

In the present application, an "axial direction" means an axial direction of a shaft.

Figure 1:
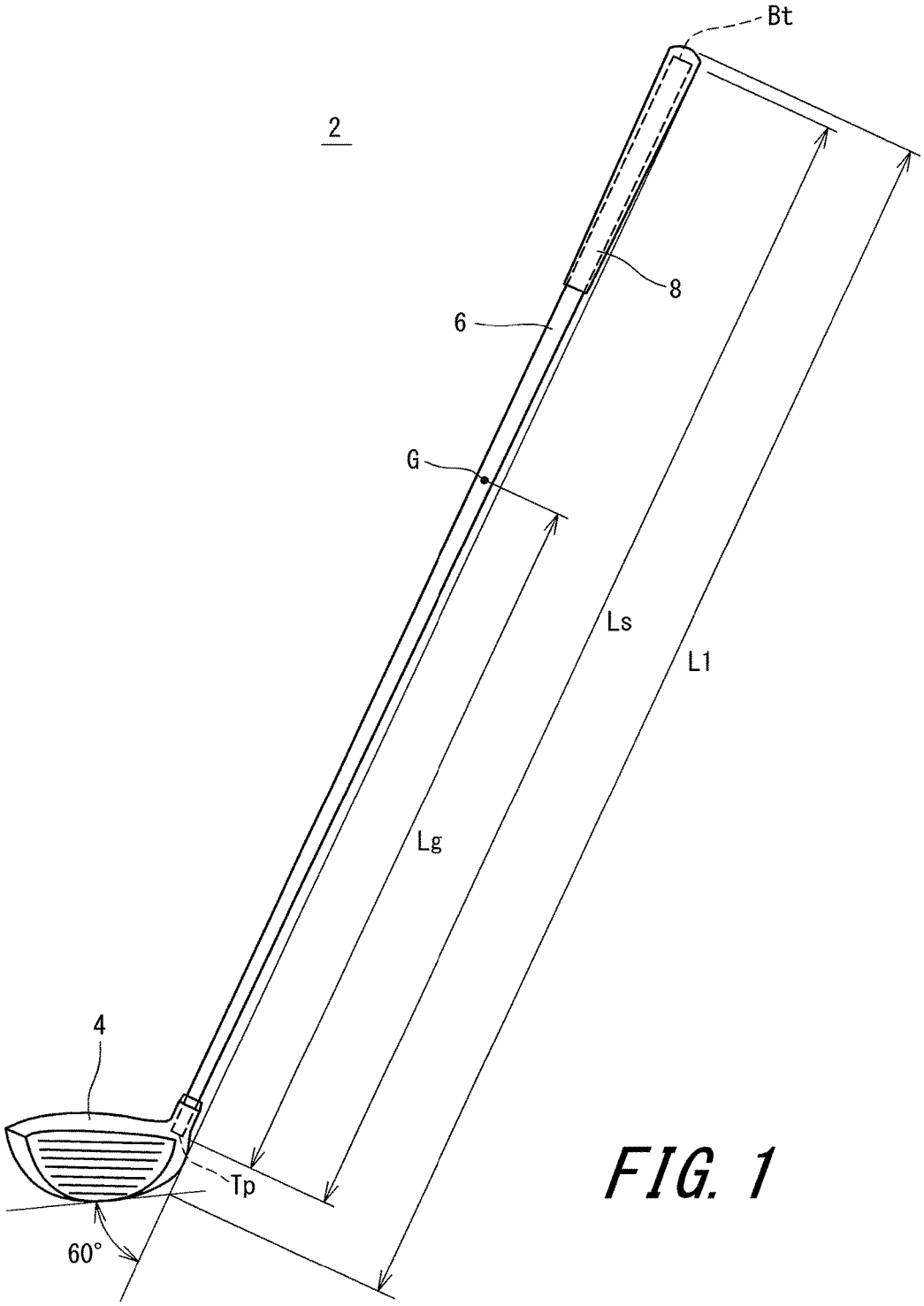
FIG. 1 shows a golf club according to an embodiment of the present invention.

FIG. 1 shows a golf club 2 according to an embodiment of the present invention. The golf club 2 includes a head 4, a shaft 6, and a grip 8. The head 4 is attached to the tip part of the shaft 6. The grip 8 is attached to the butt end part of the shaft 6. The head 4 has a hollow structure. The head 4 is a wood type head. The golf club 2 is a driver (a number 1 wood).

The golf club 2 has an excellent flight distance performance. In consideration of the flight distance performance, preferably, a club length is equal to or greater than 43 inches. In this respect, preferably, the head 4 is a wood type golf club head.

The shaft 6 includes a laminate of fiber reinforced resin layers. The shaft 6 is a tubular body. The shaft 6 has a hollow structure. As shown in FIG. 1, the shaft 6 has a tip end Tp and a butt end Bt. The tip end Tp is positioned in the head 4. The butt end Bt is positioned in the grip 8.

A shaft length is represented by a double-pointed arrow Ls in FIG. 1. The shaft length Ls is an axial-directional distance between the tip end Tp and the butt end Bt. An axial-directional distance between the tip end Tp and a center of gravity G of the shaft is represented by a double-pointed arrow Lg in FIG. 1. The center of gravity G of the shaft is the center of gravity of the single shaft 6. The center of gravity G is positioned on the axis line of the shaft. A club length is represented by a double-pointed arrow L1 in FIG. 1. A method for measuring the club length L1 will be described later.

The shaft 6 is a so-called carbon shaft. The shaft 6 is preferably produced by curing the prepreg sheet. In this prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven.

The prepreg sheet has a fiber and a resin. The resin is also referred to as a matrix resin. The fiber is typically a carbon fiber. The matrix resin is typically a thermosetting resin.

The shaft 6 is manufactured by a so-called sheet winding process. In the prepreg, the matrix resin is in a semicured state. The shaft 6 is obtained by winding and curing the prepreg sheet.

Examples of the matrix resin used for the prepreg sheet include an epoxy resin. The matrix resin may be a resin other than the epoxy resin. The matrix resin may a thermosetting resin or a thermoplastic resin. In respect of the strength of the shaft, the matrix resin is preferably the epoxy resin.

A method for manufacturing the shaft 6 is not limited. The sheet winding process is preferable in respects of light-weight properties and degree of design freedom.

Figure 2:
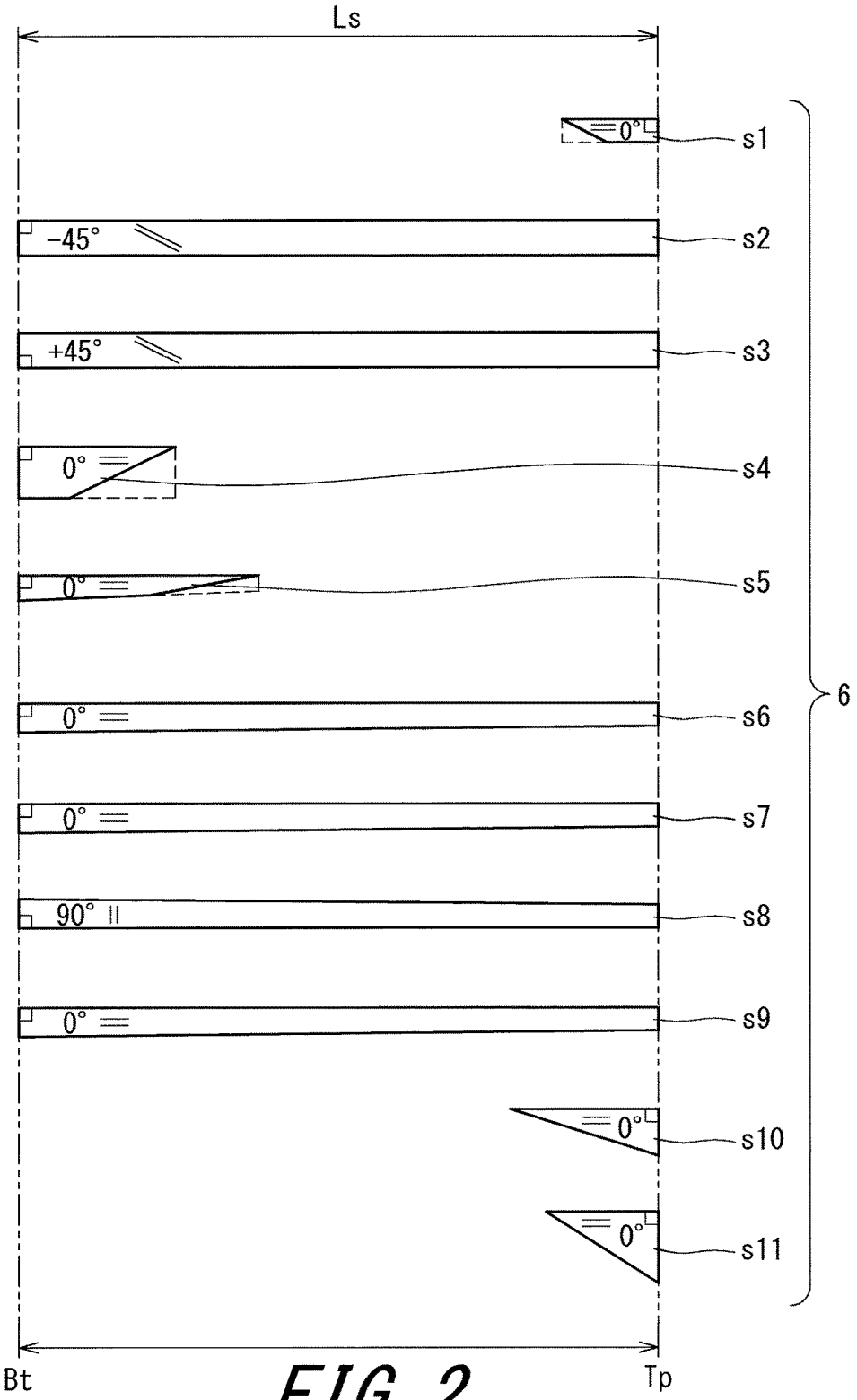
FIG. 2 is a developed view of prepreg sheets constituting a shaft used for the club of FIG. 1.

FIG. 2 is a developed view (sheet constitution view) of the prepreg sheets constituting the shaft 6. The shaft 6 includes a plurality of sheets. The shaft 6 includes eleven sheets s1 to S11. The developed view shown in FIG. 2 shows the sheets constituting the shaft in order from the radial inner side of the shaft. The sheets are wound in order from the sheet positioned on the uppermost side in the developed view. In FIG. 2, the horizontal direction of the figure coincides with the axial direction of the shaft. In FIG. 2, the right side of the figure is the tip end Tp side of the shaft. In FIG. 2, the left side of the figure is the butt end Bt side of the shaft.

The developed view shows not only the winding order of the sheets but also the arrangement of the sheets in the axial direction of the shaft. For example, in FIG. 2, the tips of the sheets s1, s10, and s11 are positioned on the tip end Tp of the shaft. For example, in FIG. 2, the back ends of the sheets s4 and s5 are positioned on the butt end Bt of the shaft.

The term "layer" and the term "sheet" are used in the present application. The "layer" is termed after being wound. Meanwhile, the "sheet" is termed before being wound. The "layer" is formed by winding the "sheet". That is, the wound "sheet" forms the "layer". In the present application, the same reference numeral is used in the layer and the sheet. For example, a layer formed by the sheet s1 is the layer s1.

The shaft 6 has a straight layer, a bias layer, and a hoop layer. In the developed view of the present application, an orientation angle Af of the fiber is described for each of the sheets. The orientation angle Af is an angle relative to the axial direction of the shaft.

A sheet described as "0 degree" constitutes the straight layer. The sheet for the straight layer is also referred to as a straight sheet in the present application.

The straight layer is a layer in which the orientation of the fiber is substantially 0 degree to the axial direction of the shaft. The orientation of the fiber may not be completely set to 0 degree to the axis direction of the shaft due to an error or the like in winding. Usually, in the straight layer, an absolute angle θa is equal to or less than 10 degrees.

The absolute angle θa is an absolute value of the orientation angle Af. For example, the absolute angle θa of equal to or less than 10 degrees means that the angle Af is −10 degrees or greater and +10 degrees or less.

The bias layer is highly correlated with the torsional rigidity and torsional strength of the shaft. Preferably, the bias sheet includes a pair of two sheets in which the orientations of fibers are inclined in opposite directions to each other. In respect of the torsional rigidity, the absolute angle θa of the bias layer is preferably equal to or greater than 15 degrees, more preferably equal to or greater than 25 degrees, and still more preferably equal to or greater than 40 degrees. In respects of the torsional rigidity and the flexural rigidity, the absolute angle θa of the bias layer is preferably equal to or less than 60 degrees, and more preferably equal to or less than 50 degrees.

In the shaft 6, the sheets constituting the bias layer are the second sheet s2 and the third sheet s3. As described above, in FIG. 2, the angle Af is described for each of the sheets. The plus (+) and minus (−) in the angle Af show that the fibers of the bias sheets are inclined in opposite directions to each other. In the present application, the sheet for the bias layer is also merely referred to as the bias sheet. The sheet s2 and the sheet s3 constitute the pair of sheets.

In the embodiment of FIG. 2, the angle Af of the sheet s2 is −45 degrees and the angle Af of the sheet s3 is +45 degrees. Needless to say, the angle Af of the sheet s2 may be +45 degrees and the angle Af of the sheet s3 may be −45 degrees.

In the shaft 6, the sheet constituting the hoop layer is the eighth sheet s8. Preferably, the absolute angle θa in the hoop layer is substantially 90 degrees to the axis line of the shaft. However, the orientation of the fiber to the axis direction of the shaft may not be completely set to 90 degrees due to an error or the like in winding. Usually, in the hoop layer, the absolute angle θa is 80 degrees or greater and 90 degrees or less. In the present application, the prepreg sheet for the hoop layer is also referred to as a hoop sheet.

The number of layers formed of a single sheet is not limited. The number of ply for a single sheet may be 1 or 2. The number of ply may be a non-integer. In respect of uniformity in the circumferential direction, preferably, the number of ply for the straight sheet is a natural number.

Although not shown in the drawings, the prepreg sheet before being used is sandwiched between cover sheets. The cover sheets are usually a mold release paper and a resin film. That is, the prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a mold release paper side surface", and the surface on which the resin film is applied is also referred to as "a film side surface".

In the developed view of the present application, the film side surface is the front side. That is, in FIG. 2, the front side of the figure is the film side surface, and the back side of the figure is the mold release paper side surface. In FIG. 2, the direction of a diagonal line representing the direction of the fiber of the sheet s2 is the same as that of the sheet s3. However, in the stacking to be described later, the sheet s3 is reversed. As a result, the directions of the fibers of the sheets s2 and s3 are opposite to each other. Therefore, the directions of the fibers of the sheets s2 and s3 are opposite to each other. In consideration of this point, in FIG. 2, the direction of the fiber of the sheet s2 is described as "−45 degrees", and the direction of the fiber of the sheet s3 is described as "+45 degrees".

In order to wind the prepreg sheet, the resin film is first peeled. The film side surface is exposed by peeling the resin film. The exposed surface has tacking property (tackiness). The tacking property is caused by the matrix resin. That is, since the matrix resin is in a semicured state, the tackiness is developed. The edge part of the exposed film side surface is also referred to as a winding start edge part. Next, the winding start edge part is applied on a wound object. The winding start edge part can be smoothly applied by the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is first peeled. Next, the winding start edge part is applied on the wound object, and the mold release paper is then peeled. That is, the resin film is first peeled, and after the winding start edge part is applied on the wound object, the mold release paper is peeled. The procedure suppresses the wrinkles and winding fault of the sheet. This is because the sheet on which the mold release paper is applied is supported by the mold release paper, and causes less wrinkle. The mold release paper has flexural rigidity higher than that of the resin film.

A united sheet is formed in the embodiment. The united sheet is formed by stacking two or more sheets.

In the embodiment, two united sheets are formed. A first united sheet is formed by stacking the sheet s3 to the sheet s2. A second united sheet is formed by stacking the sheet s8 to the sheet s9. The hoop sheet s8 is wound in the state of the united sheet. The winding method suppresses the winding fault of the hoop sheet. Examples of the winding fault include the splitting of the sheet, the disturbance of the angle Af, and wrinkles.

As described above, in the present application, the sheet and the layer are classified by the orientation angle of the fiber. Furthermore, in the present application, the sheet and the layer are classified by the axial-directional length of the shaft.

In the present application, a layer disposed wholly in the axial direction of the shaft is referred to as a full length layer. In the present application, a sheet disposed wholly in the axial direction of the shaft is referred to as a full length sheet. The wound full length sheet forms the full length layer.

In the present application, the layer partially disposed in the shaft axial direction is referred to as a partial layer. In the present application, the sheet partially disposed in the shaft axial direction is referred to as a partial sheet. The wound partial sheet forms the partial layer. In the present application, the full length layer which is a straight layer is referred to as a full length straight layer. A wound full length straight sheet forms a full length straight layer. In the embodiment in FIG. 2, the full length straight sheets are the sheet s6, the sheet s7, and the sheet s9.

In the present application, the full length layer which is the hoop layer is referred to as a full length hoop layer. In the embodiment of FIG. 2, the full length hoop layer is the sheet s8. The full length hoop sheet is the sheet s8.

In the present application, the partial layer which is the straight layer is referred to as a partial straight layer. In the embodiment of FIG. 2, the partial straight layers are the layer s1, a layer s4, a layer s5, a layer s10, and a layer s11. The partial straight sheets are the sheet s1, the sheet s4, the sheet s5, the sheet s10, and the sheet s11.

In the present application, the term "butt partial layer" is used. Examples of the butt partial layer include a butt straight layer and a butt hoop layer. In the embodiment in FIG. 2, the butt straight layers are the layer s4 and the layer s5. The butt straight sheets are the sheet s4 and the sheet s5.

In the present application, the term "tip partial layer" is used. Examples of the tip partial layer include a tip straight layer. In the embodiment in FIG. 2, the tip straight layers are the layer s1, the layer s10, and the layer s11. The tip straight sheets are the sheet s1, the sheet s10, and the sheet s11.

The shaft 6 is produced by the sheet winding process.

Hereinafter, the manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

In the stacking process, the two united sheets are produced.

In the stacking process, heating or a press may be used. More preferably, the heating and the press are used in combination. In a winding process to be described later, the deviation of the sheet may occur during the winding operation of the united sheet. The deviation reduces winding accuracy. The heating and the press improve an adhesive force between the sheets. The heating and the press suppress the deviation between the sheets in the winding process.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet on the mandrel.

The sheets are wound in the order from the sheet located on the uppermost side in the developed view of FIG. 2. The sheets to be stacked are wound in the state of the united sheet.

A winding body is obtained by the winding process. The winding body is obtained by winding the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wound around the outer peripheral surface of the winding body in the tape wrapping process. The tape is also referred to as a wrapping tape. The tape is wound while tension is applied to the wrapping tape. A pressure is applied to the winding body by the tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not limited. However, the process of removing the wrapping tape is preferably performed after the process of extracting the mandrel in respect of improving the efficiency of the process of removing the wrapping tape.

(7) Process of Cutting Both Ends

Both the end parts of the cured laminate are cut in the process. The cutting flattens the end face of the tip end Tp and the end face of the butt end Bt.

In order to facilitate the understanding, the developed view of FIG. 2 shows the sheets in the state where both the ends are cut. In fact, the cutting of both the ends is considered in the setting of the size of each of the sheets. That is, in fact, at both ends of each of the sheets, a portion to be cut is added.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to smooth the surface of the cured laminate.

(9) Coating Process

The cured laminate after the polishing process is subjected to coating.

The shaft 6 is obtained by the above processes. In the shaft 6, the ratio (Lg/Ls) is large. The shaft 6 is lightweight.

The sheet winding process has excellent degree of design freedom. The ratio (Lg/Ls) can be easily adjusted by the process. Examples of items for adjusting the ratio (Lg/Ls) include the following items (A1) to (A9).

(A1) The number of windings of the butt partial layer
(A2) The number of the butt partial sheets
(A3) The thickness of the butt partial layer
(A4) The axial-directional length of the butt partial layer
(A5) The number of windings of the tip partial layer
(A6) The number of the tip partial sheets
(A7) The thickness of the tip partial layer
(A8) The axial-directional length of the tip partial layer
(A9) The taper ratio of the shaft Examples of items for adjusting the shaft flex include the following items (B1) to (B8). The frequency of vibration of the club can be adjusted by adjusting the shaft flex.

(B1) The elastic modulus of fiber in the straight layer
(B2) The thickness of the straight layer
(B3) The number of windings of the straight layer
(B4) The polishing amount in the polishing process
(B5) The axial-directional length of the butt partial layer
(B6) The number of windings of the butt partial layer
(B7) The axial-directional length of the tip partial layer
(B8) The number of windings of the tip partial layer In the embodiment, an inertia moment Ix is used as an index for the easiness of swing. In the present application, the inertia moment Ix is referred to as a moment of inertia about an axis of a swing.

Conventionally, a swing balance (club balance) has been known as the index for the easiness of swing. However, the swing balance is a static moment, and is not a dynamic index. Meanwhile, the swing is dynamic. The inertia moment Ix about the axis of the swing was used as the index for the easiness of swing in the embodiment.

Figure 3:
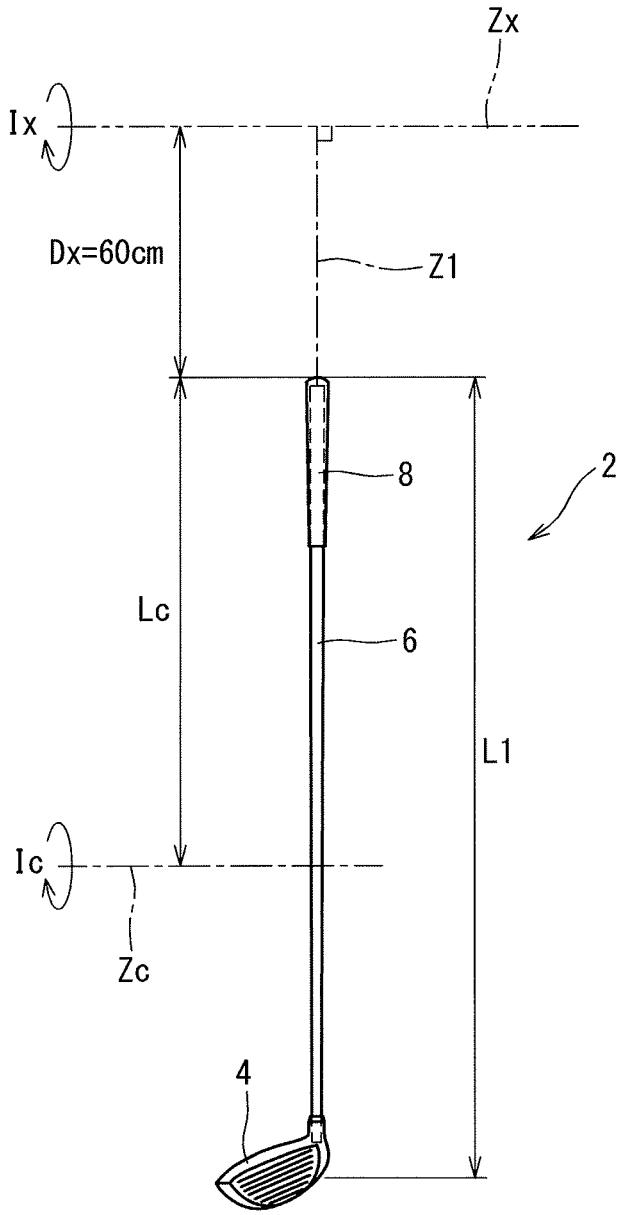
FIG. 3 illustrates a moment of inertia about a swing axis.

FIG. 3 illustrates the inertia moment Ix or the like.

[Inertia Moment (Moment of Inertia) Ix]

The inertia moment Ix is calculated by the following formula (1). The inertia moment Ix is a moment of inertia about a swing axis Zx.

$$Ix = Wc \times (Lc+60)^2 + Ic \quad (1)$$

In the formula (1), Wc is a club weight (kg); Lc (cm) is an axial-directional distance between a grip end and the center of gravity of the club; and Ic is a moment of inertia ($kg \times cm^2$) about the center of gravity of the club. The unit of the inertia moment Ix is ($kg \times cm^2$).

During an actual swing, a golf club is not rotated around a grip end. The golf club is rotated with golfer's arms around a golfer's body. In the present application, a swing axis Zx is set in consideration of the position of the golfer's body during the swing. The swing axis and the grip end are separated from each other. A separation distance Dx between the swing axis Zx and the grip end was set in order to evaluate the dynamic easiness of swing (see FIG. 3). For the separation distance Dx, many golfers' body types and swings were analyzed. As the golfers' body types, the length of arms and the like were considered. As a result, it has been found that the suitable separation distance Dx is about 60 cm. In this way, a value of [Lc+60] is used in the formula (1) in consideration of the actual condition of the swing.

The swing is dynamic. As compared with a static index, a dynamic index can reflect the easiness of swing with accuracy. Furthermore, as described above, the actual condition of the swing is considered in the inertia moment Ix. Therefore, in the inertia moment Ix, the easiness of swing is reflected with accuracy. The easiness of swing contributes to the improvement of the head speed. The easiness of swing contributes to the improvement of the meet rate. Because of the easiness of swing, a flight distance can be increased.

An axis Zc shown in FIG. 3 passes through the center of gravity of the club. The axis Zc is parallel to the swing axis Zx. An inertia moment Ic is a moment of inertia of the club 2 about the axis Zc. The swing axis Zx is perpendicular to an axis line Z1 of the shaft. The axis Zc is perpendicular to the axis line Z1 of the shaft. In the above-mentioned formula (1), the moment Ix is calculated by the parallel axis theorem.

In the present application, a reference state (not shown) is defined. The reference state is a state where a sole of the club 2 is placed at a prescribed lie angle and real loft angle on a level surface. In the reference state, the axis line Z1 of the shaft is included in a plane VP1 perpendicular to the level surface. The plane VP1 is defined as a reference perpendicular plane. The prescribed lie angle and real loft angle are published in catalogs of products, for example. As is clear from FIG. 3, in the measurement of each moment of inertia, a face surface is brought into a substantial square state with respect to a head path. The direction of the face surface is in an ideal impact state. The swing axis Zx is included in the reference perpendicular plane. That is, in the measurement of the inertia moment Ix, the swing axis Zx is included in the reference perpendicular plane. In the measurement of the inertia moment Ic, the axis Zc is included in the reference perpendicular plane. The above-mentioned each moment of inertia reflects the posture of the club near an impact. The above-mentioned each moment of inertia reflects the swing. Therefore, these moments of inertia are highly correlated with the easiness of swing. The inertia moment Ic can be measured using MODEL NUMBER RK/005-002 manufactured by INERTIA DYNAMICS, for example.

The center of gravity of the club is considered to be positioned on the axis line Z1 of the shaft. The slight shift of the true center of gravity of the club from the axis line Z1 of the shaft is caused by the position of the center of gravity of the head. The true center of gravity of the club can be positioned in a space, for example. In the present application, a point on the axis line Z1 closest to the true center of gravity of the club is considered to be the center of gravity of the club. In other words, the center of gravity of the club in the present application is an intersection point of a perpendicular line down to the axis line Z1 from the true center of gravity of the club with the axis line Z1. The approximation of the position of the center of gravity of the club may apply a fine difference to the value of the inertia moment Ix. However, the difference is small to the extent that it does not influence the effect described in the present application.

In a golfer having good physical strength and a high head speed, the variation in a hit ball tends to be great. A club having excellent stability is preferable for such a golfer. In consideration of the easiness of swing and stability, it is preferable that the inertia moment Ix of the club is appropriately set.

In respects of the easiness of swing and stability, the inertia moment Ix is preferably equal to or greater than $7.20 \times 10^3$ ($kg \cdot cm^2$), more preferably equal to or greater than $7.25 \times 10^3$ ($kg \cdot cm^2$), and still more preferably equal to or greater than $7.30 \times 10^3$ ($kg \cdot cm^2$). In respects of the easiness of swing and stability, the inertia moment Ix is preferably equal to or less than $7.50 \times 10^3$ ($kg \cdot cm^2$), more preferably equal to or less than $7.45 \times 10^3$ ($kg \cdot cm^2$), and still more preferably equal to or less than $7.40 \times 10^3$ ($kg \cdot cm^2$).

The easiness of swing can be improved by the suppressed inertia moment Ix. The easiness of swing contributes to improvement in a head speed. The head weight Wh is considered to be decreased as means for decreasing the inertia moment Ix. However, if the head weight Wh is merely decreased, the kinetic energy of the head is reduced. In this case, a coefficient of restitution and a ball initial speed are reduced.

In the embodiment, Wh/Wc is increased. That is, a ratio of the head weight Wh to the club weight Wc is enhanced. The kinetic energy of the head can be increased by increasing the weight Wh distributed to the head in the club weight Wc. Therefore, the coefficient of restitution and the ball initial speed can be enhanced.

In the embodiment, the inertia moment Ix is limited in a predetermined range while Wh/Wc is increased. Therefore, although the head weight Wh is large, the easiness of swing is obtained. As a result, the head speed can be increased while the head weight Wh is increased. The synergy of the head weight Wh with the head speed can increase the ball initial speed and the kinetic energy of the head. Thus, the flight distance performance can be improved.

The club balance is generally used as the index of the easiness of swing. If the head weight Wh is increased, the club balance also tends to be increased. For this reason, the lightening of the club balance has been considered to be the same as the lightening of the head weight Wh. A technical thought (defined as a technical thought A) in which the easiness of swing and the weight saving of the head weight Wh are be united together has been known. The technical thought A has been general in the person skilled in the art. Meanwhile, in the embodiment, the weight is largely distributed to the head while the club is easily to be swung. Although the constitution is contrary to the technical thought A, the constitution is effective in the improvement in the flight distance performance.

In the present application, the static moment of the club is defined as Mt. The static moment Mt is calculated by the following formula (2). The unit of the static moment Mt is kg×cm.

$$Mt = Wc \times (Lc - 35.6) \quad (2)$$

The static moment Mt corresponds to a 14-inch type swing balance. The swing balance is obtained by encoding the value of the static moment Mt.

In respect of stability, the static moment Mt is preferably equal to or greater than 16.0 kg·cm, more preferably equal to or greater than 16.1 kg·cm, and still more preferably equal to or greater than 16.2 kg·cm. When the club length L1 or the like is set to a preferable value, the static moment Mt is preferably equal to or less than 18.0 kg·cm, more preferably equal to or less than 17.5 kg·cm, still more preferably equal to or less than 17.1 kg·cm, and yet still more preferably equal to or less than 17.0 kg·cm.

Preferably, the ratio (Ix/Mt) is small. In other words, preferably, the inertia moment Ix is small and the static moment Mt is great. The constitution can limit the inertia moment Ix while bringing the center of gravity of the club closer to the head. Therefore, the inertia moment Ix can be limited while the ratio Wh/Wc is increased.

The decreased Ix/Mt means that the inertia moment Ix is small while the static moment Mt is relatively great. In other words, this means that the inertia moment Ix is small while the club balance is relatively heavy. Therefore, due to the small ratio Ix/Mt, the easiness of swing tends to be improved while the club balance is relatively heavy. As described above, the index for the easiness of swing was conventionally the club balance. Conventionally, there was a technical thought (technical thought B) in which the club was less easily to be swung if the club balance was heavy. The technical thought B could not assume a concept that the club was easily to be swung although the club balance was heavy.

When the ratio Ix/Mt is small, the club is easily to be swung although the static moment Mt is great. The easiness of swing can contribute to the improvement of the flight distance performance. In this respect, the ratio Ix/Mt is preferably equal to or less than 465, more preferably equal to or less than 464, still more preferably equal to or less than 463, yet still more preferably equal to or less than 460, and yet still more preferably equal to or less than 455. In consideration of the strengths of the head, shaft, and grip, there is a limit on the decrease of the inertia moment Ix. In consideration of the point, the ratio Ix/Mt is preferably equal to or greater than 415, more preferably equal to or greater than 420, still more preferably equal to or greater than 425, and yet still more preferably equal to or greater than 428. In consideration of the easiness of swing by a golfer having good physical strength, the ratio Ix/Mt is preferably equal to or greater than 430, more preferably equal to or greater than 435, still more preferably equal to or greater than 440, and yet still more preferably equal to or greater than 445.

[Wh/Wc]

A weight distribution rate to the head is preferably enhanced in order to increase the kinetic energy of the head. In this respect, Wh/Wc is preferably equal to or greater than 0.66, more preferably equal to or greater than 0.67, and still more preferably equal to or greater than 0.68. In consideration of the strengths or the like of the shaft and grip, the shaft weight and the grip weight are preferably equal to or greater than a predetermined value. In this respect, Wh/Wc is preferably equal to or less than 0.80, more preferably equal to or less than 0.79, and still more preferably equal to or less than 0.78.

Needless to say, in the calculation of Wh/Wc, the unit of the head weight Wh is coincided with that of the club weight Wc. For example, if the unit of the head weight Wh is "kg", the unit of the club weight Wc is also "kg". If the unit of the head weight Wh is "g", the unit of the club weight Wc is also "g".

If the ratio Wh/Wc is great, the flexure of the shaft is increased, and the behavior of the shaft is apt to be unstable. This unstable behavior may decrease the meet rate.

An excessively great flexure of the shaft during swing may delay the timing of returning the flexure. The delay of the timing can degrade the head speed. A club whose flexure is slowly returned is less easily to be swung.

In respect of the easiness of swing, preferably, an excessively great flexure caused by an increase in the ratio Wh/Wc is suppressed. In respect of the meet rate, preferably, an unstable behavior of the shaft caused by an increase in the ratio Wh/Wc is suppressed.

The frequency of vibration of the club is considered, so that the easiness of swing can be secured even when the ratio Wh/Wc is increased. The frequency of vibration of the club is considered, so that the behavior of the shaft can stabilize even when the ratio Wh/Wc is increased. Therefore, the stability can be secured, and the variation in a hit ball can be suppressed. In these respects, the frequency of vibration of the club is preferably equal to or greater than 240 (cpm), more preferably equal to or greater than 245 (cpm), and more preferably equal to or greater than 250 (cpm). If the flexure is excessively small, the head speed and the easiness of swing may decrease. In this respect, the frequency of vibration of the club is preferably equal to or less than 290 (cpm), more preferably equal to or less than 285 (cpm), still more preferably equal to or less than 280 (cpm), and yet still more preferably equal to or less than 275 (cpm). The frequency of vibration of the club can be adjusted by the head weight Wh and the shaft flex or the like.

[Head Weight Wh]

The initial speed of the ball at the hitting can be enhanced by increasing the kinetic energy of the head. In this respect, the head weight Wh is preferably equal to or greater than 190 g (0.190 kg), more preferably equal to or greater than 195 g (0.195 kg), still more preferably equal to or greater than 200 g (0.200 kg), and yet still more preferably equal to or greater than 205 g (0.205 kg). In respect of the easiness of swing, the head weight Wh is preferably equal to or less than 250 g (0.250 kg), more preferably equal to or less than 245 g (0.245 kg), and still more preferably equal to or less than 240 g (0.240 kg).

[Shaft Weight Ws]

In respects of the strength and durability of the shaft, the shaft weight Ws is preferably equal to or greater than 35 g, more preferably equal to or greater than 38 g, and still more preferably equal to or greater than 40 g. In consideration of the easiness of swing by a golfer having good physical strength, the shaft weight Ws is preferably equal to or greater than 45 g, more preferably equal to or greater than 48 g, still more preferably equal to or greater than 49 g, yet still more preferably equal to or greater than 50 g, yet still more preferably equal to or greater than 51 g, and yet still more preferably equal to or greater than 52 g. In respect of considering that the stability is important, the shaft weight Ws is preferably equal to or greater than 53 g, more preferably equal to or greater than 54 g, and still more preferably equal to or greater than 55 g. In respect of the easiness of swing, the shaft weight Ws is preferably equal to or less than 75 g, more preferably equal to or less than 70 g, still more preferably equal to or less than 69 g, yet still more preferably equal to or less than 68 g, yet still more preferably equal to or less than 67 g, yet still more preferably equal to or less than 66 g, and yet still more preferably equal to or less than 65 g. In respect of considering that the flight distance is important, the shaft weight Ws is preferably equal to or less than 64 g, more preferably equal to or less than 63 g, still more preferably equal to or less than 62 g, yet still more preferably equal to or less than 61 g, and yet still more preferably equal to or less than 60 g.

[Grip Weight Wg]

In respects of the strength and durability of the grip, the grip weight Wg is preferably equal to or greater than 20 g, more preferably equal to or greater than 23 g, and still more preferably equal to or greater than 25 g. In respect of the stability, the grip weight Wg is preferably equal to or greater than 28 g, more preferably equal to or greater than 29 g, and still more preferably equal to or greater than 30 g. In respect of the easiness of swing, the grip weight is preferably equal to or less than 50 g, more preferably equal to or less than 45 g, and still more preferably equal to or less than 40 g. In respect of considering that the flight distance is important, the grip weight Wg is preferably equal to or less than 38 g, and more preferably equal to or less than 35 g. The grip weight Wg can be adjusted by the volume of the grip, the specific gravity of rubber, and the use of foam rubber, or the like.

[Shaft Length Ls]

In respect of increasing the rotational radius of the swing to enhance the head speed, the shaft length Ls is preferably equal to or greater than 99 cm, more preferably equal to or greater than 105 cm, still more preferably equal to or greater than 107 cm, and yet more preferably equal to or greater than 110 cm. In respect of suppressing the variation in a hit point, the shaft length Ls is preferably equal to or less than 120 cm, more preferably equal to or less than 118 cm, and more preferably equal to or less than 116 cm.

[Distance Lg]

The easiness of swing and the head speed can be improved by bringing the center of gravity G closer to the butt end Bt. In this respect, the distance Lg (see FIG. 1) is preferably equal to or greater than 540 mm, more preferably equal to or greater than 550 mm, still more preferably equal to or greater than 560 mm, yet still more preferably equal to or greater than 570 mm, yet still more preferably equal to or greater than 580 mm, and yet still more preferably equal to or greater than 590 mm. When the distance Lg is excessively large, since the weight that can be allocated to the tip part of the shaft is decreased, the strength of the tip part of the shaft is apt to decrease. In this respect, the distance Lg is preferably equal to or less than 751 mm, more preferably equal to or less than 750 mm, still more preferably equal to or less than 745 mm, and yet still more preferably equal to or less than 740 mm.

[Lg/Ls]

In respect of decreasing the inertia moment Ix about the axis of the swing while increasing the head weight Wh, Lg/Ls is preferably equal to or greater than 0.55, more preferably equal to or greater than 0.56, and still more preferably equal to or greater than 0.57. In respect of enhancing the strength of the tip part of the shaft, Lg/Ls is preferably equal to or less than 0.67, more preferably equal to or less than 0.66, and still more preferably equal to or less than 0.65.

[Club Length L1]

In respect of enhancing the head speed, the club length L1 is preferably equal to or greater than 43 inches, more preferably equal to or greater than 44 inches, and still more preferably equal to or greater than 45 inches. In respect of suppressing the variation in the hit points, the club length L1 is preferably equal to or less than 48 inches, more preferably equal to or less than 47.5 inches, and still more preferably equal to or less than 47 inches.

The club length L1 in the present application is measured based on "1c Length" in "1 Clubs" of "Appendix II Design of Clubs" in the Golf Rules defined by R&A (Royal and Ancient Golf club of Saint Andrews).

The flight distance tends to be considered important in a wood type golf club. The tendency is high in a driver. In this respect, the club is preferably the driver. In respect of the flight distance performance, the real loft is preferably 7 degrees or greater and 13 degrees or less. In respect of the moment of inertia of the head, the volume of the head is preferably equal to or greater than 350 cc, more preferably equal to or greater than 380 cc, still more preferably equal to or greater than 400 cc, and yet still more preferably equal to or greater than 420 cc. In respect of the strength to the head, the volume of the head is preferably equal to or less than 470 cc.

[Club Weight Wc]

In respect of improving the ratio Wh/Wc, the club weight Wc is preferably equal to or less than 320 g (0.320 kg), more preferably equal to or less than 315 g (0.315 kg), still more preferably equal to or less than 310 g (0.310 kg), yet still more preferably equal to or less than 309 g (0.309 kg), yet still more preferably equal to or less than 308 g (0.308 kg), yet still more preferably equal to or less than 307 g (0.307 kg), and yet still more preferably equal to or less than 306 g (0.306 kg). In respect of considering that the flight distance is important, the club weight Wc is preferably equal to or less than 305 g (0.305 kg), more preferably equal to or less than 304 g (0.304 kg), still more preferably equal to or less than 303 g (0.303 kg), and yet still more preferably equal to or less than 302 g (0.302 kg). In respect of the strengths of the shaft and the head, the club weight is preferably equal to or greater than 250 g (0.250 kg), more preferably equal to or greater than 260 g (0.260 kg), and still more preferably equal to or greater than 270 g (0.270 kg). In respect of considering that the stability is important, the club weight may be equal to or greater than 280 g (0.280 kg), and may be equal to or greater than 290 g (0.290 kg).

EXAMPLES

Hereinafter, the effects of the present invention will be clarified by examples. However, the present invention should not be interpreted in a limited way based on the description of examples.

The following Table 1 shows examples of prepregs capable of being used for a shaft of the present invention.

Example 1

A shaft having the same laminated constitution as that of the shaft 6 was produced. That is, a shaft having the sheet constitution shown in FIG. 2 was produced. A manufacturing method was the same as that of the shaft 6.

The shaft according to example 1 was formed using the prepregs shown in Table 1. The prepreg "HRX350C-110S" was used for the bias layer. The prepregs whose tensile elastic modulus was 23.5 to 30 (t/mm$^2$) were used for the straight layer. These prepregs are shown in Table 1. The prepregs were selected so as to have desired values for a ratio Wh/Wc, a shaft weight, a ratio Lg/Ls, and a frequency of vibration of a club, or the like. The shaft according to example 1 was obtained by the manufacturing method described above.

A commercially available driver head (SRIXON 2725 manufactured by DUNLOP SPORTS CO., LTD.: a loft angle of 9.5 degrees) and a grip were attached to the obtained shaft, to obtain a golf club according to example 1. The specifications and evaluation result of example 1 are shown in the following Table 2.

TABLE 1

Examples of prepregs capable of being used

| Manufacturer | Part number of prepreg sheet | Thickness of sheet (mm) | Fiber content rate (% by mass) | Resin content rate (% by mass) | Physical property value of carbon fiber: Part number of carbon fiber | Tensile elastic modulus (t/mm$^2$) | Tensile strength (kgf/mm$^2$) |
|---|---|---|---|---|---|---|---|
| TORAY Industries, Inc. | 3255S-10 | 0.082 | 76 | 24 | T700S | 23.5 | 500 |
| TORAY Industries, Inc. | 3255S-12 | 0.103 | 76 | 24 | T700S | 23.5 | 500 |
| TORAY Industries, Inc. | 3255S-15 | 0.123 | 76 | 24 | T700S | 23.5 | 500 |
| TORAY Industries, Inc. | 805S-3 | 0.034 | 60 | 40 | M30S | 30 | 560 |
| TORAY Industries, Inc. | 2255S-10 | 0.082 | 76 | 24 | T800S | 30 | 600 |
| TORAY Industries, Inc. | 2255S-12 | 0.102 | 76 | 24 | T800S | 30 | 600 |
| TORAY Industries, Inc. | 2255S-15 | 0.123 | 76 | 24 | T800S | 30 | 600 |
| TORAY Industries, Inc. | 2256S-10 | 0.077 | 80 | 20 | T800S | 30 | 600 |
| TORAY Industries, Inc. | 2256S-12 | 0.103 | 80 | 20 | T800S | 30 | 600 |
| Nippon Graphite Fiber Corporation | E1026A-09N | 0.100 | 63 | 37 | XN-10 | 10 | 190 |
| Mitsubishi Rayon Co., Ltd. | TR350C-100S | 0.083 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | MR350C-075S | 0.063 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MR350C-125S | 0.105 | 75 | 25 | MR40 | 30 | 450 |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

A tensile strength and a tensile elastic modulus are values measured based on JIS R7601: 1986 "Test Method for Carbon Fibers".

Examples 2 to 16 and Comparative Examples 1 to 9

Shafts and heads according to examples and comparative examples were obtained in the same manner as example 1 except the specifications shown in the following Tables 2 to 7.

In these examples and comparative examples, a head weight Wh was adjusted by polishing the overall outer surface of the head and using a weight adjustment adhesive. The adhesive was applied to the inner surface of the head. The adhesive is a thermoplastic adhesive, fixed to a predetermined position on the inner surface of the head at room temperature, and flows at high temperature. While the temperature of the adhesive was set at high temperature, the adhesive was poured into the head, and then cooled at ambient temperature for fixing. The adhesive was disposed so as not to change the position of the center of gravity of the head.

In these examples and comparative examples, a grip weight Wg was adjusted by the material of the grip. Foam rubber was used for grips having a small weight Wg.

The shaft flex and the ratio (Lg/Ls) were adjusted based on the items (A1) to (A9) and (B1) to (B8). The specifications of examples and comparative examples were obtained based on these adjustments. The specifications of examples and comparative examples are shown in the following Tables 2 to 7. In Tables, example 5 is described at a plurality of places for easy comparison of data.

TABLE 2

Specifications and evaluation results of Examples and Comparative Examples

| | Comparative Example 1 | Example 1 | Example 2 | Example 3 | Comparative Example 2 |
|---|---|---|---|---|---|
| Club weight Wc (g) | 297.0 | 301.5 | 306.0 | 313.4 | 317.9 |
| Club length L1 (inch) | 45 | 45 | 45 | 45 | 45 |
| Inertia moment Ix (kg · cm$^2$) about swing axis | 7100 | 7200 | 7300 | 7500 | 7600 |
| Ix/Mt | 455 | 450 | 453 | 455 | 452 |
| Static moment Mt (kg · cm) | 15.6 | 16.0 | 16.1 | 16.5 | 16.8 |
| Frequency of vibration of club (cpm) | 260 | 260 | 260 | 260 | 260 |
| Head weight Wh (g) | 199 | 202 | 205 | 210 | 213 |
| Wh/Wc | 0.67 | 0.67 | 0.67 | 0.67 | 0.67 |
| Shaft weight Ws (g) | 56.0 | 57.5 | 59.0 | 61.4 | 62.9 |
| Shaft length Ls (mm) | 1121 | 1121 | 1121 | 1121 | 1121 |
| Distance Lg between tip and center of gravity of shaft (mm) | 639 | 639 | 639 | 639 | 639 |
| Distance between butt and center of gravity of shaft (mm) | 482 | 482 | 482 | 482 | 482 |
| Lg/Ls | 0.57 | 0.57 | 0.57 | 0.57 | 0.57 |
| Grip weight Wg (g) | 40 | 40 | 40 | 40 | 40 |
| Head speed (m/s) | 48.6 | 48.4 | 48.0 | 47.4 | 46.5 |
| Kinetic energy (J) | 235.0 | 236.6 | 236.2 | 235.9 | 230.3 |
| Flight distance (yards) | 299 | 305 | 305 | 304 | 295 |
| Variation in hit ball (yards) | 23.6 | 18.8 | 18.6 | 18.2 | 17.9 |
| Shaft durability | A | A | A | A | A |

TABLE 3

Specifications and evaluation results of Examples and Comparative Examples

| | Comparative Example 3 | Example 4 | Example 5 | Example 6 |
|---|---|---|---|---|
| Club weight Wc (g) | 315.4 | 310.6 | 306.0 | 301.5 |
| Club length L1 (inch) | 45 | 45 | 45 | 45 |
| Inertia moment Ix (kg · cm$^2$) about swing axis | 7430 | 7370 | 7300 | 7250 |
| Ix/Mt | 459 | 455 | 453 | 450 |
| Static moment Mt (kg · cm) | 16.2 | 16.2 | 16.1 | 16.1 |
| Frequency of vibration of club (cpm) | 260 | 260 | 260 | 260 |
| Head weight Wh (g) | 205 | 205 | 205 | 205 |
| Wh/Wc | 0.65 | 0.66 | 0.67 | 0.68 |
| Shaft weight Ws (g) | 68.4 | 63.6 | 59.0 | 54.5 |
| Shaft length Ls (mm) | 1121 | 1121 | 1121 | 1121 |
| Distance Lg between tip and center of gravity of shaft (mm) | 639 | 639 | 639 | 639 |
| Distance between butt and center of gravity of shaft (mm) | 482 | 482 | 482 | 482 |
| Lg/Ls | 0.57 | 0.57 | 0.57 | 0.57 |
| Grip weight Wg (g) | 40 | 40 | 40 | 40 |
| Head speed (m/s) | 47.6 | 47.8 | 48.0 | 48.2 |
| Kinetic energy (J) | 232.2 | 234.2 | 236.2 | 238.1 |
| Flight distance (yards) | 295 | 302 | 305 | 307 |
| Variation in hit ball (yards) | 18.5 | 18.5 | 18.6 | 18.6 |
| Shaft durability | A | A | A | A |

TABLE 4

Specifications and evaluation results of Examples and Comparative Examples

| | Example 7 | Example 5 | Example 8 | Comparative Example 4 |
|---|---|---|---|---|
| Club weight Wc (g) | 306.0 | 306.0 | 306.0 | 306.0 |
| Club length L1 (inch) | 45 | 45 | 45 | 45 |
| Inertia moment Ix (kg · cm$^2$) about swing axis | 7350 | 7300 | 7280 | 7250 |
| Ix/Mt | 451 | 453 | 455 | 456 |
| Static moment Mt (kg · cm) | 16.3 | 16.1 | 16.0 | 15.9 |
| Frequency of vibration of club (cpm) | 260 | 260 | 260 | 260 |
| Head weight Wh (g) | 205 | 205 | 205 | 205 |
| Wh/Wc | 0.67 | 0.67 | 0.67 | 0.67 |
| Shaft weight Ws (g) | 59.0 | 59.0 | 59.0 | 59.0 |
| Shaft length Ls (mm) | 1121 | 1121 | 1121 | 1121 |
| Distance Lg between tip and center of gravity of shaft (mm) | 617 | 639 | 661 | 684 |
| Distance between butt and center of gravity of shaft (mm) | 504 | 482 | 460 | 437 |
| Lg/Ls | 0.55 | 0.57 | 0.59 | 0.61 |
| Grip weight Wg (g) | 40 | 40 | 40 | 40 |
| Head speed (m/s) | 47.9 | 48.0 | 48.1 | 48.2 |
| Kinetic energy (J) | 235.2 | 236.2 | 237.1 | 238.1 |
| Flight distance (yards) | 303 | 305 | 306 | 307 |
| Variation in hit ball (yards) | 18.4 | 18.6 | 18.8 | 21.5 |
| Shaft durability | A | A | A | B |

TABLE 5

Specifications and evaluation results of Examples and Comparative Examples

| | Example 9 | Example 5 | Example 10 | Comparative Example 5 |
|---|---|---|---|---|
| Club weight Wc (g) | 306.0 | 306.0 | 306.0 | 306.0 |
| Club length L1 (inch) | 45 | 45 | 45 | 45 |
| Inertia moment Ix (kg · $cm^2$) about swing axis | 7400 | 7300 | 7280 | 7230 |
| Ix/Mt | 448 | 453 | 455 | 461 |
| Static moment Mt (kg · cm) | 16.5 | 16.1 | 16.0 | 15.7 |
| Frequency of vibration of club (cpm) | 260 | 260 | 260 | 260 |
| Head weight Wh (g) | 205 | 205 | 205 | 205 |
| Wh/Wc | 0.67 | 0.67 | 0.67 | 0.67 |
| Shaft weight Ws (g) | 69.0 | 59.0 | 55.0 | 49.0 |
| Shaft length Ls (mm) | 1121 | 1121 | 1121 | 1121 |
| Distance Lg between tip and center of gravity of shaft (mm) | 639 | 639 | 639 | 639 |
| Distance between butt and center of gravity of shaft (mm) | 482 | 482 | 482 | 482 |
| Lg/Ls | 0.57 | 0.57 | 0.57 | 0.57 |
| Grip weight Wg (g) | 30 | 40 | 44 | 50 |
| Head speed (m/s) | 47.7 | 48.0 | 48.1 | 48.2 |
| Kinetic energy (J) | 233.2 | 236.2 | 237.1 | 238.1 |
| Flight distance (yards) | 301 | 305 | 306 | 307 |
| Variation in hit ball (yards) | 18.2 | 18.6 | 18.8 | 22.2 |
| Shaft durability | A | A | A | B |

TABLE 6

Specifications and evaluation results of Examples and Comparative Examples

| | Example 11 | Example 12 | Example 5 | Example 13 | Example 14 |
|---|---|---|---|---|---|
| Club weight Wc (g) | 306.0 | 306.0 | 306.0 | 306.0 | 306.0 |
| Club length L1 (inch) | 45 | 45 | 45 | 45 | 45 |
| Inertia moment Ix (kg · $cm^2$) about swing axis | 7300 | 7300 | 7300 | 7300 | 7300 |
| Ix/Mt | 453 | 453 | 453 | 453 | 453 |
| Static moment Mt (kg · cm) | 16.1 | 16.1 | 16.1 | 16.1 | 16.1 |
| Frequency of vibration of club (cpm) | 230 | 240 | 260 | 290 | 300 |
| Head weight Wh (g) | 205 | 205 | 205 | 205 | 205 |
| Wh/Wc | 0.67 | 0.67 | 0.67 | 0.67 | 0.67 |
| Shaft weight Ws (g) | 59.0 | 59.0 | 59.0 | 59.0 | 59.0 |
| Shaft length Ls (mm) | 1121 | 1121 | 1121 | 1121 | 1121 |
| Distance Lg between tip and center of gravity of shaft (mm) | 639 | 639 | 639 | 639 | 639 |
| Distance between butt and center of gravity of shaft (mm) | 482 | 482 | 482 | 482 | 482 |
| Lg/Ls | 0.57 | 0.57 | 0.57 | 0.57 | 0.57 |
| Grip weight Wg (g) | 40 | 40 | 40 | 40 | 40 |
| Head speed (m/s) | 48.0 | 48.1 | 48.0 | 47.9 | 47.6 |
| Kinetic energy (J) | 236.2 | 237.1 | 236.2 | 235.2 | 232.2 |
| Flight distance (yards) | 300 | 306 | 305 | 303 | 300 |
| Variation in hit ball (yards) | 20.5 | 19.9 | 18.6 | 15.0 | 14.0 |
| Shaft durability | A | A | A | A | A |

TABLE 7

Specifications and evaluation results of Examples and Comparative Examples

| | Comparative Example 6 | Comparative Example 7 | Example 15 | Example 5 | Comparative Example 8 | Example 16 | Comparative Example 9 |
|---|---|---|---|---|---|---|---|
| Club weight Wc (g) | 337.3 | 306.0 | 328.4 | 306.0 | 306.0 | 283.6 | 283.6 |
| Club length L1 (inch) | 42 | 43 | 43 | 45 | 48 | 48 | 49 |
| Inertia moment Ix (kg · $cm^2$) about swing axis | 7450 | 6920 | 7450 | 7300 | 7920 | 7300 | 7500 |
| Ix/Mt | 466 | 464 | 463 | 453 | 442 | 445 | 441 |
| Static moment Mt (kg · cm) | 16.0 | 14.9 | 16.1 | 16.1 | 17.9 | 16.4 | 17.0 |
| Frequency of vibration of club (cpm) | 260 | 260 | 260 | 260 | 260 | 260 | 260 |
| Head weight Wh (g) | 226 | 205 | 220 | 205 | 205 | 190 | 190 |
| Wh/Wc | 0.67 | 0.67 | 0.67 | 0.67 | 0.67 | 0.67 | 0.67 |
| Shaft weight Ws (g) | 69.3 | 59.0 | 66.4 | 59.0 | 59.0 | 51.6 | 51.6 |
| Shaft length Ls (mm) | 1045 | 1070 | 1070 | 1121 | 1197 | 1197 | 1222 |
| Distance Lg between tip and center of gravity of shaft (mm) | 596 | 610 | 610 | 639 | 682 | 682 | 697 |
| Distance between butt and center of gravity of shaft (mm) | 449 | 460 | 460 | 482 | 515 | 515 | 525 |
| Lg/Ls | 0.57 | 0.57 | 0.57 | 0.57 | 0.57 | 0.57 | 0.57 |
| Grip weight Wg (g) | 40 | 40 | 40 | 40 | 40 | 40 | 40 |
| Head speed (m/s) | 44.9 | 47.9 | 46.2 | 48.0 | 47.2 | 50.1 | 50.1 |
| Kinetic energy (J) | 227.8 | 235.2 | 234.8 | 236.2 | 228.4 | 238.5 | 238.5 |
| Flight distance (yards) | 294 | 303 | 303 | 305 | 295 | 308 | 293 |
| Variation in hit ball (yards) | 18.8 | 23.5 | 17.2 | 18.6 | 16.8 | 19.0 | 25.2 |
| Shaft durability | A | A | A | A | A | A | A |

[Frequency of Vibration of Club]

Figure 4:
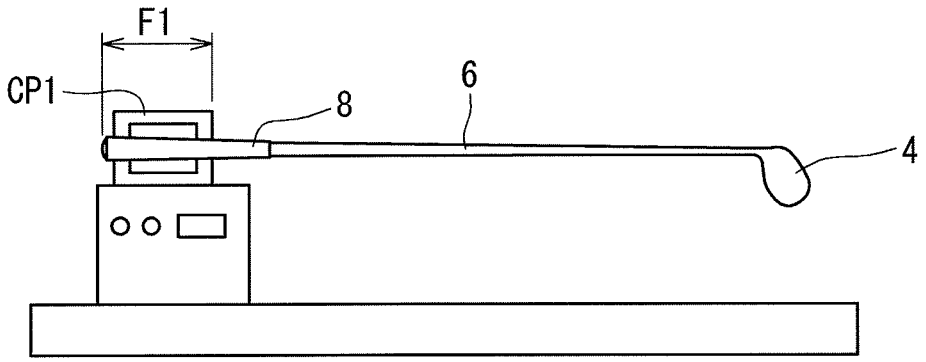
FIG. 4 shows a method for measuring the frequency of vibration of a club.

"GOLF CLUB TIMING HARMONIZER" (trade name) manufactured by Fujikura Rubber Ltd. was used for measuring the frequency of vibration of the club. FIG. 4 is a diagram for explaining a measuring method of the frequency of vibration of the club. A portion between a point separated by 7 inches from a grip end and the grip end was fixed with a clamp CP1. That is, a length F1 of the fixed portion was 7 inches (about 178 mm). An optional load was applied to the head 4 downward, and the shaft 6 was vibrated. The frequency of vibration per minute is the frequency of vibration of the club (cpm). The measured values are shown in Tables 2 to 7.

[Moment of Inertia]

The inertia moment Ix was calculated by the formula (1) described above. The club inertia moment Ic was measured using MODEL NUMBER RK/005-002 manufactured by INERTIA DYNAMICS Inc.

[Head Speed]

Five testers whose handicaps were 0 or greater and 10 or less conducted the evaluation. The general head speeds of these five testers were 45 to 50 (m/s). The head speeds of the five testers are high. Each tester hits a ball with each club ten times. Therefore, hits were made 50 times for the each of the clubs in total. In these hits, the head speed was measured at impact. The mean values of 50 data are shown in Tables 2 to 7.

[Kinetic Energy]

The kinetic energy (J) was calculated using the mean value of the obtained head speeds. The calculated values are shown in Tables 2 to 7. The calculation formula of the kinetic energy K is as follows, if the head weight is defined as Wh, and the head speed (mean value) is defined as Vh.

$$K=Wh\times(Vh)^2/2$$

[Flight Distance]

In respect of improving the reliability of data, two hits of small flight distances were not adopted in the ten hits described above. As a result, 40 hitting data were obtained in total. The flight distance is a distance (a so-called carry) to a spot where a ball falls to the ground. The mean values of 40 flight distance data are shown in Tables 2 to 7.

[Variation in Hit Ball]

A deviation width of the spot where a ball fell to the ground to the target direction was measured. The deviation width is a distance (yard) between a straight line connecting a spot where a ball was hit and a target spot to each other and the spot where a ball fell to the ground. Irrespective of either right or left the ball was deviated to, the deviation width was defined as a plus value. The mean value of deviation widths was calculated for the 40 hitting data described above. The mean values are shown in Tables 2 to 7.

[Shaft Durability]

The club was attached to a swing robot manufactured by Miyamae Co., Ltd., and the head speed was set to 55 m/s. A hit point was at a location separated by 20 mm on a heel side from a face center. "DDH TOUR SPECIAL" manufactured by DUNLOP SPORTS CO., LTD. was used as a golf ball. The ball was repeatedly hit, and the state of the shaft was confirmed after every 500 hits. The shaft was evaluated as "A" when the shaft was not damaged after 10,000 hits. When breakage was confirmed before 10,000 hits, the shaft was evaluated as "B". These evaluations are shown in Tables 2 to 7.

When the static moment Mt was small, the head weight Wh was small and a flight distance was short. Since the behavior of the shaft is less likely to be stable in this case, the variation in a hit ball is great (see comparative example 1 in Table 2).

When the inertia moment Ix was excessively great, the head speed was less likely to be increased, and a flight distance was short (see comparative example 2 in Table 2).

When the ratio (Wh/Wc) was excessively small, the kinetic energy was decreased and energy efficiency was also decreased, which provided a short flight distance (see comparative example 3 in Table 3).

When the center of gravity G of the shaft was located close to the butt end Bt and the ratio (Lg/Ls) was excessively great, the strength of the tip part of the shaft was apt to decrease (see comparative example 4 in Table 4).

When the shaft weight Ws was small in the club weight Wc, the strength of the shaft was comparatively apt to decrease (see comparative example 5 in Table 5).

When the frequency of vibration of the club was excessively small, the behavior of the shaft became unstable during swing and the meet rate was apt to decrease. Therefore, the variation in a hit ball was great (see example 11 in Table 6). The meet rate means the probability that the ball is hit in a sweet area.

When the frequency of vibration of the club was excessively great, the flexure of the shaft was small, and the head speed was decreased. Thus, a flight distance was comparatively short (see example 14 in Table 6).

When the club length L1 was excessively small, the rotational radius of swing was small and the head speed was apt to decrease. Thus, the head speed was low and a flight distance was short (see comparative example 6 in Table 7).

As a result that the club length L1 is short and the head weight Wh was small, the static moment Mt could be excessively small. In this case, the variation in a hit ball was great (see comparative example 7 in Table 7).

As a result that the club length L1 was great, the inertia moment Ix could be excessively great. In this case, the head speed was not increased although the club length L1 was great, and the meet rate was small. Thus, a flight distance was short (see comparative example 8 in Table 7).

When the club length L1 was excessively great, the meet rate was decreased. Thus, and a flight distance was short and the variation in a hit ball was great (see comparative example 9 in Table 7).

As shown in Tables, thus, the advantages of the present invention are apparent.

The method described above is applicable to all golf clubs.

The description hereinabove is merely for an illustrative example, and various modifications can be made in the scope not to depart from the principles of the present invention.

What is claimed is:

1. A golf club comprising: a head; a shaft; and a grip, wherein a club length is 43 inches or greater and 48 inches or less;

a ratio (Wh/Wc) of a head weight Wh to a club weight Wc is equal to or greater than 0.66;

an inertia moment Ix about a swing axis is $7.20\times10^3$ (kg·cm$^2$) or greater and $7.50\times10^3$ (kg·cm$^2$) or less;

a static moment Mt (kg·cm) of the club is equal to or greater than 16.0 (kg·cm); and if the club weight is defined as Wc (kg); an axial-directional distance between a grip end and a center of gravity of the club is defined as Lc (cm); and a club inertia moment about the center of gravity of the club is defined as Ic (kg·cm$^2$), the inertia moment Ix (kg·cm$^2$) is calculated by the following formula (1), and the static moment Mt (kg·cm) is calculated by the following formula (2)

$$Ix=Wc\times(Lc+60)^2+Ic \quad (1)$$

$$Mt=Wc\times(Lc-35.6) \quad (2).$$

2. The golf club according to claim 1, wherein a frequency of vibration of the club is 240 (cpm) or greater and 290 (cpm) or less.

3. The golf club according to claim 2, wherein the ratio (Wh/Wc) is equal to or greater than 0.67.

4. The golf club according to claim 1, wherein the ratio (Wh/Wc) is equal to or greater than 0.67.

5. The golf club according to claim 1, wherein the inertia moment Ix (kg·cm$^2$) is equal to or greater than $7.25\times10^3$ (kg·cm$^2$).

6. The golf club according to claim 1, wherein the inertia moment Ix (kg·cm$^2$) is equal to or less than $7.45\times10^3$ (kg·cm$^2$) and equal to or greater than $7.20\times10^3$ (kg·cm$^2$).

7. The golf club according to claim 1, wherein the static moment Mt is equal to or less than 18.0 (kg·cm) and equal to or greater than 16.0 (kg·cm).

8. The golf club according to claim 1, wherein the ratio (Ix/Mt) of the inertia moment Ix (kg·cm$^2$) to the static moment Mt (kg·cm) is 430 or greater and 465 or less.

* * * * *